US008608588B2

(12) United States Patent
Horii

(10) Patent No.: US 8,608,588 B2
(45) **Date of Patent: *Dec. 17, 2013**

(54) PUTTER HEAD

(75) Inventor: Daisuke Horii, Shinagawa-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 210 days.

This patent is subject to a terminal disclaimer.

(21) Appl. No.: 12/505,749

(22) Filed: Jul. 20, 2009

(65) Prior Publication Data

US 2010/0167838 A1 Jul. 1, 2010

(30) Foreign Application Priority Data

Dec. 25, 2008 (JP) ..... 2008-329709

(51) Int. Cl.
*A63B 53/04* (2006.01)
*A63B 53/06* (2006.01)

(52) U.S. Cl.
USPC ..... 473/334; 473/340; 473/349

(58) Field of Classification Search
USPC ..... 473/231, 238, 244, 251, 324–350
See application file for complete search history.

(56) References Cited

U.S. PATENT DOCUMENTS

| | | | | | |
|---|---|---|---|---|---|
| 2,155,830 | A | * | 4/1939 | Howard | 473/246 |
| 2,171,383 | A | * | 8/1939 | Wettlaufer | 473/335 |
| 2,932,515 | A | * | 4/1960 | May | 473/248 |
| 3,516,674 | A | * | 6/1970 | Scarborough | 473/311 |
| 4,052,075 | A | * | 10/1977 | Daly | 473/338 |
| 5,308,076 | A | | 5/1994 | Sun | |
| 5,429,356 | A | * | 7/1995 | Dingle et al. | 473/251 |
| 5,527,035 | A | * | 6/1996 | Marshall | 473/230 |
| 5,533,725 | A | | 7/1996 | Reynolds, Jr. | |
| 5,558,332 | A | * | 9/1996 | Cook | 473/341 |
| 5,577,965 | A | * | 11/1996 | Burgess | 473/230 |
| 5,683,309 | A | * | 11/1997 | Reimers | 473/337 |
| 5,709,613 | A | * | 1/1998 | Sheraw | 473/248 |
| 5,769,737 | A | * | 6/1998 | Holladay et al. | 473/336 |
| 5,910,055 | A | * | 6/1999 | Bennett | 473/305 |
| 5,916,042 | A | * | 6/1999 | Reimers | 473/334 |
| 5,993,324 | A | * | 11/1999 | Gammil | 473/251 |
| 5,997,409 | A | * | 12/1999 | Mattson | 473/244 |
| 6,019,686 | A | * | 2/2000 | Gray | 473/313 |
| 6,203,444 | B1 | * | 3/2001 | McRae | 473/244 |
| 6,270,422 | B1 | * | 8/2001 | Fisher | 473/223 |
| 6,379,264 | B1 | * | 4/2002 | Forzano | 473/336 |

(Continued)

FOREIGN PATENT DOCUMENTS

| | | | |
|---|---|---|---|
| DE | 3711964 | A1 * | 10/1988 |
| GB | 2 327 889 | A | 2/1999 |

(Continued)

OTHER PUBLICATIONS

Japanese Office Action dated Sep. 11, 2012 issued in Japanese Patent Application No. 2008-329709.

*Primary Examiner* — Alvin Hunter
(74) *Attorney, Agent, or Firm* — Sughrue Mion, PLLC

(57) ABSTRACT

A putter head has a moment of inertia that can be adjusted easily by the golfer himself or herself. A putter head includes a body member having a face surface for hitting a ball and a back member turnably installed at the body member. The back member includes a plurality of movable parts, and the movable parts are turnably fixed to the body part. The movable part is turnably installed with one screw only.

16 Claims, 3 Drawing Sheets

(56) References Cited

U.S. PATENT DOCUMENTS

| | | | | |
|---|---|---|---|---|
| 6,428,423 | B1 * | 8/2002 | Merko | 473/307 |
| 6,478,694 | B2 | 11/2002 | Anderson et al. | |
| 6,558,268 | B2 * | 5/2003 | Tindale | 473/244 |
| 6,749,523 | B1 * | 6/2004 | Forzano | 473/330 |
| 6,863,617 | B2 * | 3/2005 | Park | 473/226 |
| 6,964,619 | B1 * | 11/2005 | Mejia | 473/286 |
| 6,988,956 | B2 * | 1/2006 | Cover et al. | 473/244 |
| 6,991,555 | B2 * | 1/2006 | Reese | 473/251 |
| 7,004,849 | B2 | 2/2006 | Cameron | |
| 7,018,304 | B2 * | 3/2006 | Bradford | 473/334 |
| 7,048,646 | B2 | 5/2006 | Yamanaka et al. | |
| 7,070,515 | B1 * | 7/2006 | Liu | 473/340 |
| 7,104,899 | B1 * | 9/2006 | Caserta | 473/236 |
| 7,108,609 | B2 * | 9/2006 | Stites et al. | 473/256 |
| 7,121,956 | B2 * | 10/2006 | Lo | 473/335 |
| 7,201,669 | B2 * | 4/2007 | Stites et al. | 473/337 |
| 7,204,765 | B2 * | 4/2007 | Cover et al. | 473/244 |
| 7,297,073 | B2 * | 11/2007 | Jung | 473/340 |
| 7,326,121 | B2 * | 2/2008 | Roake | 473/251 |
| 7,335,112 | B1 * | 2/2008 | Bitondo et al. | 473/238 |
| 7,354,356 | B2 | 4/2008 | Yamanaka et al. | |
| 7,429,218 | B2 * | 9/2008 | Pinder | 473/244 |
| 7,431,660 | B2 * | 10/2008 | Hasegawa | 473/251 |
| 7,442,129 | B2 * | 10/2008 | Bardha | 473/251 |
| 7,594,865 | B2 * | 9/2009 | Ines | 473/334 |
| 7,604,546 | B2 * | 10/2009 | Brown | 473/230 |
| 7,651,409 | B1 * | 1/2010 | Mier | 473/330 |
| 7,695,376 | B2 * | 4/2010 | Kaczmarz et al. | 473/244 |
| 7,722,478 | B2 * | 5/2010 | Ebner | 473/335 |
| 7,758,451 | B2 * | 7/2010 | Liang et al. | 473/334 |
| 7,771,286 | B2 * | 8/2010 | Campadore et al. | 473/252 |
| 7,775,905 | B2 * | 8/2010 | Beach et al. | 473/334 |
| 7,824,280 | B2 * | 11/2010 | Yokota | 473/334 |
| 8,177,664 | B2 * | 5/2012 | Horii et al. | 473/340 |
| 2006/0094533 | A1 * | 5/2006 | Warren et al. | 473/337 |
| 2007/0004534 | A1 * | 1/2007 | Lee et al. | 473/340 |

FOREIGN PATENT DOCUMENTS

| | | | | |
|---|---|---|---|---|
| GB | 2327889 | A | * | 2/1999 |
| GB | 2339699 | A | * | 2/2000 |
| JP | 6-9666 | U | | 2/1994 |
| JP | 06238022 | A | * | 8/1994 |
| JP | 09239079 | A | * | 9/1997 |
| JP | 11-114112 | A | | 4/1999 |
| JP | 2000237360 | A | * | 9/2000 |
| JP | 2001000606 | A | * | 1/2001 |
| JP | 2001-224718 | A | | 8/2001 |
| JP | 2001-231898 | A | | 8/2001 |
| JP | 2002-224253 | A | | 8/2002 |
| JP | 2003-210629 | A | | 7/2003 |
| JP | 2004033536 | A | * | 2/2004 |
| JP | 2005-066249 | A | | 3/2005 |
| JP | 2005296582 | A | * | 10/2005 |
| JP | 2005323978 | A | * | 11/2005 |
| JP | 2006075304 | A | * | 3/2006 |
| JP | 2006101918 | A | * | 4/2006 |
| JP | 2006198385 | A | * | 8/2006 |
| JP | 2006239351 | A | * | 9/2006 |
| JP | 2006320493 | A | * | 11/2006 |
| JP | 2007029498 | A | * | 2/2007 |
| JP | 2008-036315 | A | | 2/2008 |
| JP | 2008194454 | A | * | 8/2008 |
| WO | WO 9006157 | A1 | * | 6/1990 |

* cited by examiner

PUTTER HEAD

BACKGROUND OF THE INVENTION

The present invention relates to a putter head.

In a golf game, final putting often decides the game, and not only the golfer's capability of putting but also the performance and characteristics of a putter are one of the factors in deciding the game. Therefore, the adjustability of the performance and characteristics of a putter according to the physical condition of the golfer on the play day and the kind and condition of green lawn is advantageous to the golfer.

For example, Japanese Patent Application Publication No. 2001-224718 describes a putter head formed by combining four parts to change the center of gravity of a putter head. The putter head is configured so that the four parts consist of a body, two wing parts located on both sides of the body, and a bottom part, and by fitting protrusions of the bottom part in grooves formed in the body and the wing parts, the parts are connected to each other. By forming the right and left wing parts by using materials having a different specific gravity, the center of gravity of the putter head can be changed to the right or the left.

In the configuration described in Japanese Patent Application Publication No. 2001-224718, however, although the center of gravity of the putter head can be changed greatly by changing the specific gravity of the right and left wing parts of the putter head, it is difficult to greatly change the moment of inertia of the putter head. Also, in the configuration described in Japanese Patent Application Publication No. 2001-224718, the number of parts constituting the putter head is large, and therefore it is not easy to assemble a putter head having a strength capable of withstanding putting by using these many parts.

Also, Japanese Patent Application Publication No. 2005-66249 describes a putter head provided with a front half body having a face surface and an arcuate rear half body attached to the rear side of the front half body. The front half body is formed of a metal having a small specific gravity, and the arcuate rear half body is formed of a metal having a high specific gravity. Therefore, the moment of inertia around the center of gravity of putter head is high, and the sweet area of the putter head is large. However, Japanese Patent Application Publication No. 2005-66249 does not especially describe that the moment of inertia of putter head is adjusted. Also, in the configuration described in Japanese Patent Application Publication No. 2005-66249, the front half body and the rear half body are fixed with two bolts, so that this configuration is still insufficient for the golfer himself or herself to adjust the moment of inertia easily.

SUMMARY OF THE INVENTION

The present invention has been made to solve the above problems, and accordingly, an object thereof is to provide a putter head such that the moment of inertia thereof can be adjusted easily by the golfer himself or herself.

To achieve the above object, a putter head in accordance with the present invention includes a body member having a face surface for hitting a ball and a back member turnably installed to the body member, and is characterized in that the back member is turnably installed to the body member with one screw only. Preferably, the back member has two movable parts, and these two movable parts are arranged on the toe side and the heel side of the body member, each of the movable parts being turnably installed with the one screw only.

The body member preferably has a specific gravity less than that of the back member. Also, the body member preferably has a hardness less than that of the back member. Preferably, the putter head in accordance with the present invention further includes a means for fixing an angle of the back member turnable with respect to the body member. As a positioning means for fixing such an angle, preferably, a convex part or a concave part is provided on the body member, and a concave part for accommodating the convex part or a convex part inserted into the concave part is provided on the back member that turns. The means for fixing the angle preferably can fix the back member at a plurality of angles, for example, at angles of two to four stages, with respect to the body member.

According to the present invention, as described above, the putter head includes the back member turnably installed to the body member, and the back member is turnably installed to the body member with one screw only. Therefore, the golfer himself or herself can adjust the moment of inertia of the putter head easily.

DESCRIPTION OF THE PREFERRED EMBODIMENTS

Figure 1:
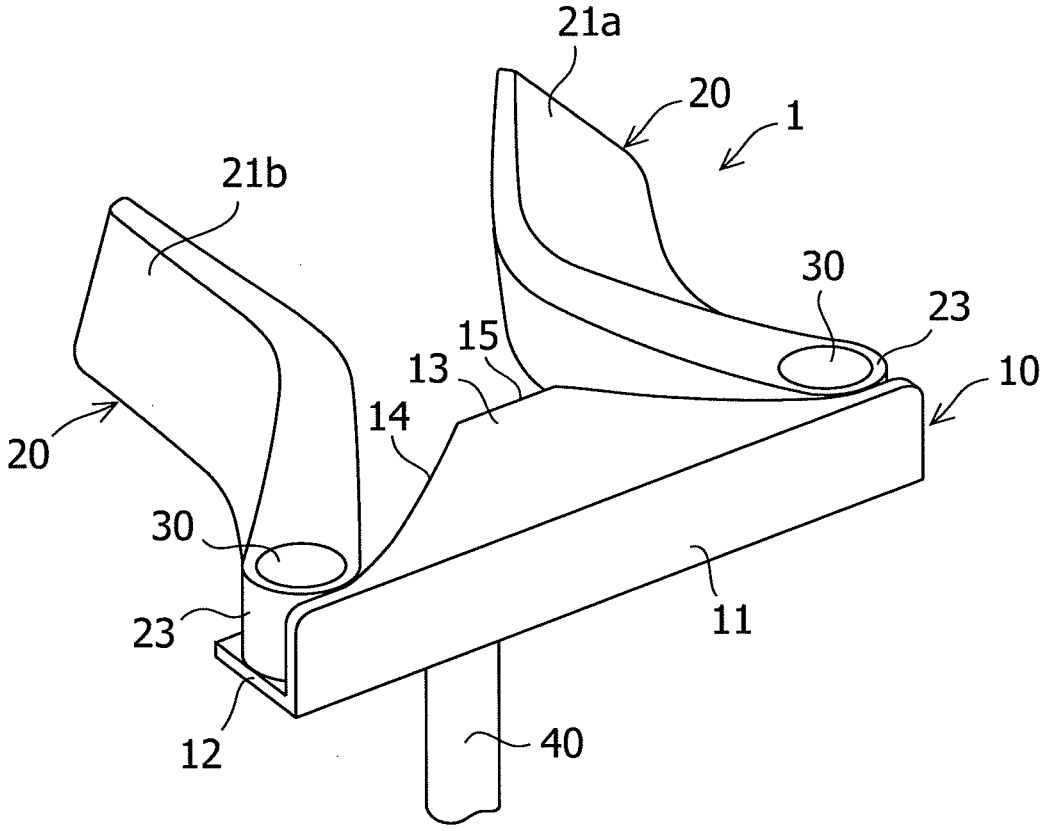
FIG. 1 is a perspective view showing one embodiment of a putter head in accordance with the present invention, viewed from obliquely below at the front.
Figure 2A:
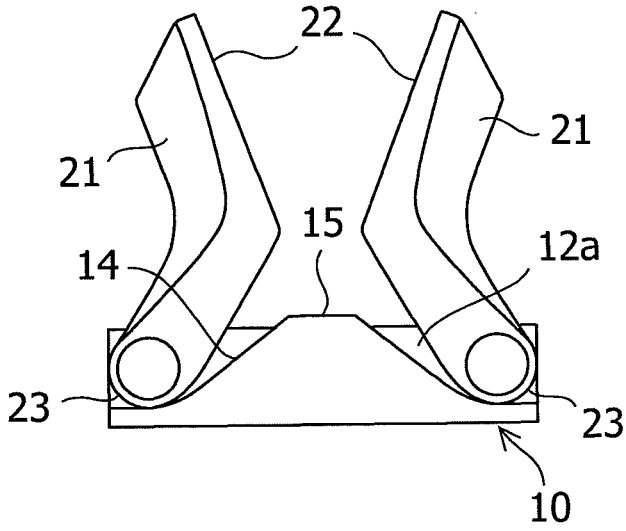
FIG. 2A is a bottom plan view of the putter head shown in FIG. 1, showing the states before and after the turning of movable parts.
Figure 2B:
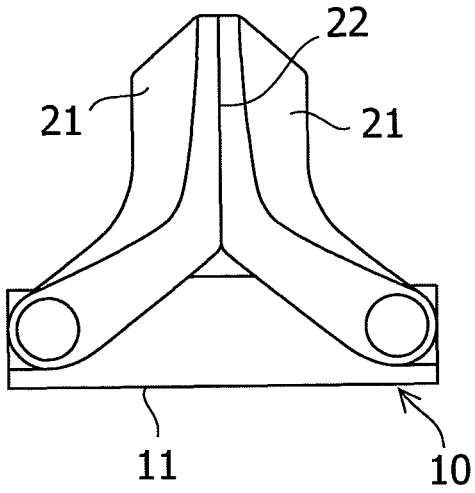
FIG. 2B is a bottom plan view of the putter head shown in FIG. 1, showing the states before and after the turning of movable parts.

One embodiment of a putter head in accordance with the present invention will now be described with reference to the accompanying drawings. FIG. 1 is a perspective view showing one embodiment of the putter head in accordance with the present invention, viewed from obliquely below at the front. FIGS. 2A and 2B are bottom plan views of the putter head shown in FIG. 1, showing the states before and after the turning of movable parts.

As shown in FIG. 1, a putter head 1 of this embodiment is composed mainly of a body member 10 having a face surface 11 for hitting a ball, a back member 20 turnably installed to the body member 10, and a hosel 40 attached to the body member 10.

The body member 10 includes, in addition to the face surface 11, a crown part 12, a sole part 13, side parts 14, and a back part 15. To the surface of the crown part 12 of the body member 10, the hosel 40 is fixed. Also, the surface area of the crown part 12 is greater than that of the sole part 13, and back surfaces 12*a* are exposed to the sole side. As shown in the figures, the crown part 12 has a rectangular shape, and the sole part 13 has a substantially isosceles triangular shape such that the face surface 11 is the base and the back part 15 is the vertex. The two sides each having an equal length are the side parts 14 on the toe side and the heel side. As shown in the figures, the back part 15 can also take a shape formed by chamfering the vertex angle.

On the back surfaces 12*a* of the crown part 12, the back member 20 extending toward the rear of the putter head 1 is provided. As the back member 20, as shown in the figures, movable parts 21 are provided on the toe side and the heel side of the crown part 12. A movable part 21*a* on the toe side and a movable part 21*b* on the heel side preferably take a shape axially symmetrical with respect to the centerline of the putter head 1. For example, as shown in FIGS. 2A and 2B, the shape can be made such that a tip end part 22*a* of the movable part 21*a* on the toe side is curved to the toe side, and a tip end part 22*b* of the movable part 21*b* on the heel side is curved to the heel side. Also, as shown in FIG. 2B, the shape can be made such that the movable parts 21 on the toe side and the heel side come into contact with each other in the tip end parts 22.

Figure 3A:
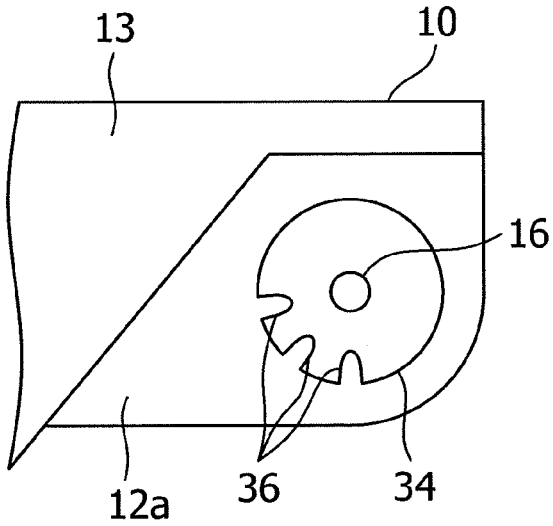
FIG. 3A is an enlarged view of an essential portion at the time and shows the body member side when the putter head shown in FIG. 1 is disassembled.
Figure 3B:
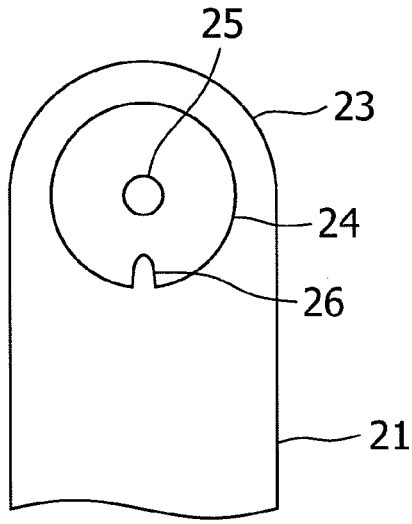
FIG. 3B is an enlarged view of an essential portion at the time and shows the back member side when the putter head shown in FIG. 1 is disassembled.

Each of the movable parts 21 of the back member 20 is turnably fixed to the back surface 12*a* of the crown part 12 with one screw 30. The back member 20 is provided with fixing parts 23 in the end portions on the opposite side to the tip end parts 22 of the movable parts 21. FIGS. 3A and 3B show enlarged views of the body member 10 and the back member 20 disassembled from each other. FIG. 3A shows the back surface 12*a* of the crown part 12, and FIG. 3B shows the crown-side surface of the fixing part 23 of the back member 20. When the back member 20 is fixed to the body member 10, the surfaces shown in FIGS. 3A and 3B are assembled so as to face to each other.

As shown in FIG. 3A, in the back surface 12*a* of the crown part 12, a threaded hole 16 with which an external thread part (not shown) of the screw 30 engages threadedly is provided. Also, as shown in FIG. 3B, in the fixing part 23 of the back member 20, a through hole 25 through which the external thread part of the screw 30 passes is provided.

Also, the putter head 1 is provided with a positioning means for fixing the movable part 21 at a predetermined angle with respect to the body member 10. As the positioning means, as shown in FIG. 3A, a protruding part 34 is provided on the back surface 12*a* of the crown part 12 of the body member 10. Also, as shown in FIG. 3B, in the fixing part 23 of the back member 20, an opening part 24 for accommodating the protruding part 34 is provided. The protruding part 34 on the back surface 12*a* of the crown part 12 has a cylindrical shape having an outer periphery concentric with the threaded hole 16. In the side surface of the protruding part 34, plural grooves 36 extending in parallel with the threaded hole 16 are provided. On the other hand, the opening part 24 is also formed into a circular shape concentric with the through hole 25. On the side surface of the opening part 24, a protrusion 26 engaging with the groove 36 is provided.

The body member 10 preferably has a specific gravity less than that of the back member 20. By making the specific gravity of the body member small and making that of the back member 20 large, the moment of inertia of the putter head 1 can be changed significantly by changing the angle between the movable parts 21 of the back member 20. Also, the body member 10 preferably has a hardness lower than that of the back member 20. By making the hardness of the body member 10 low, the hitting feeling at the time when a ball is hit by the face surface can be made soft.

As a material that meets the above-described conditions, for example, aluminum, aluminum alloy, titanium, or titanium alloy can be used for the body member 10. As the aluminum alloy, AC4C (specific gravity: 2.7, Vickers hardness: about 200) or the like can be used. Also, for the back member 20, stainless steel, copper alloy, tungsten alloy, or the like can be used. As the stainless steel, SUS630 (specific gravity: 7.8, Vickers hardness: about 400) or the like can be used.

Although not shown in the figures, in the case in which a concavity is provided in the face surface 11 of the body member 10, and an insert formed of a polymer material is arranged in this concavity, too, the hitting feeling at the time when a ball is hit can be made soft. As the polymer material capable of being used for the insert, synthetic resin, thermoplastic elastomer, and the like are available.

As the synthetic resin, urethane resin can be used. As the thermoplastic elastomer, for example, urethane-based thermoplastic elastomer, polyamide-based thermoplastic elastomer, or polyester-based thermoplastic elastomer can be used.

The screw 30 is preferably made of a metal, further preferably made of the same material as that of the body member 10 or the back member 20. As the material for the screw 30, for example, aluminum, aluminum alloy, or stainless steel can be used. Although not shown in the figures, in the surface of the head part of the screw 30, a slot or a cross hole can be provided.

According to the above-described configuration, when the putter head 1 is to be assembled, first, the protruding part 34 provided on the back surface 12*a* of the crown part 12 of the body member 10 is inserted into the opening part 24 of the fixing part 23 of the back member 20. At this time, the protrusion 26 provided at the outer periphery of the opening part 24 is fitted in one of the plurality of grooves 36 provided at the outer periphery of the protruding part 34. The plurality of grooves 36 are provided at intervals at the outer periphery of the circular protruding part 34. Therefore, by changing the groove 36 in which the protrusion 26 is fitted, the angle between the movable parts 21 of the back member 20 with respect to the body member 10 can be changed in a multistage manner. Also, by inserting the protruding part 34 into the opening part 24, the through hole 25 positioned at the center of the opening part 24 is made to align with the threaded hole 16 positioned at the center of the protruding part 34.

After the protruding part 34 has been installed in the opening part 24 at a position at which the movable parts 21 are at a predetermined angle with respect to the body member 10 as described above, the external thread part of the screw 30 is inserted into the through hole 25 in the fixing part 23 of the back member 20. Then, the screw 30 is turned so that the external thread part of the screw 30 is threadedly engaged with the threaded hole 16 in the back surface 12*a* of the crown part 12 of the body member 10. When the screw 30 is tightened, the fixing part 23 of the back member 20 is fixed to the back surface 12*a* of the crown part 12. Thus, the two movable parts 21 on the toe side and the heel side are fixed at a predetermined angle.

Although each of the movable parts 21 on the toe side and the heel side of the back member 20 is fixed to the body member 10 with one screw 30 only, the protrusion 23 in the opening part 24 of the back member 20 fits in the groove 36 at the outer periphery of the protruding part 34 of the body member 10. Therefore, even if some load is applied to the movable part 21 of the back member 20, the movable part 21 can be prevented from moving with respect to the body member 10.

Next, when the back member 20 is to be fixed to the body member 10 by changing the angle between the movable parts 21 of the back member 20 with respect to the body member 10, for example, from FIG. 2A to FIG. 2B, first, the screw 30 is loosened. Then, the fixing part 23 of the back member 20 is separated from the back surface 12*a* of the crown part 12 of the body member 10 until the protrusion 26 of the opening part 24 comes off the groove 36 in the protruding part 34. Thereby, the movable part 21 can be turned freely with the threaded hole 16 or the through hole 25 being the axis.

After the angle between the movable parts 21 of the back member 20 has been changed, the protruding part 34 of the body member 10 is again inserted to the farthest portion of the opening part 24 of the back member 20. The protrusion 26 at the outer periphery of the opening part 24 fits in another groove 36 at the outer periphery of the protruding part 34. By tightening the screw 30 again, the movable part 21 of the back member 20 can be fixed to the back surface 12*a* of the crown part 12 at the different angle.

Since the movable parts 21 of the back member 20 are turnably fixed to the body member 10 as described above, the entire shape of the back member 20 can be changed as shown in FIGS. 2A and 2B. For example, if the angle that the paired movable parts 21 make is increased to, for example, 60 degrees or more, the moment of inertia of the putter head 1 increases, so that the sweet area can be extended. The angle between the movable parts 21 is preferably 80 degrees or larger. However, if the angle between the movable parts 21 is too large, that is, the movable parts 21 are opened excessively, the length in the toe-to-heel direction of the putter head 1 increases, and therefore swing becomes difficult to perform. Therefore, the angle between the movable parts 21 is preferably 95 degrees or less. On the other hand, if the angle between the movable parts 21 is decreased to, for example, 30 degrees, the moment of inertia of the putter head 1 decreases, so that the hitting feeling can be made sensitive. The further preferred angle between the movable parts 21 in this case is 0 degrees.

As described above, according to the present invention, since the movable parts 21 of the back member 20 are turnably fixed to the body member 10, by changing the angle between the movable parts 21 by turning the movable parts 21 of the back member 20, the moment of inertia of the putter head 1 can be changed. In the case in which the weight of the putter head 1 is in the range of 300 to 400 g, by turning the movable parts 21, the moment of inertial around the center of gravity of the putter head 1 (the axis perpendicular to the horizontal plane is the reference) can be changed in the range of 3000 to 9000 $g \cdot cm^2$. For example, the plurality of grooves 36 provided at the outer periphery of the protruding part 34 can be provided at intervals such that if the position shifts by one groove, the moment of inertia around the center of gravity changes 200 $g \cdot cm^2$ or more, preferably 500 $g \cdot cm^2$ or more.

Figure 4A:
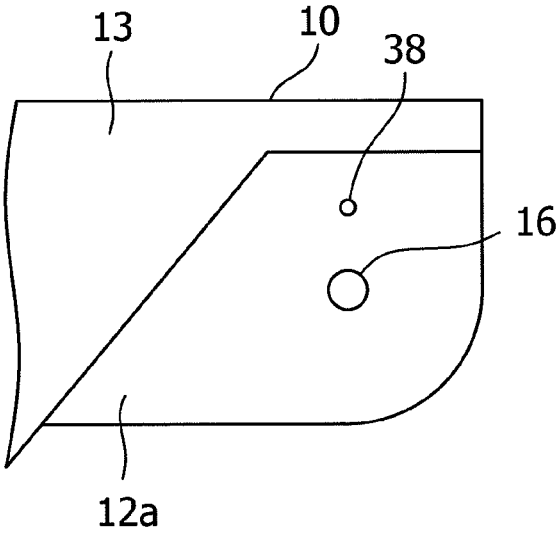
FIG. 4A is an enlarged view of an essential portion at the time and shows the body member side when a putter head in accordance with another embodiment is disassembled.
Figure 4B:
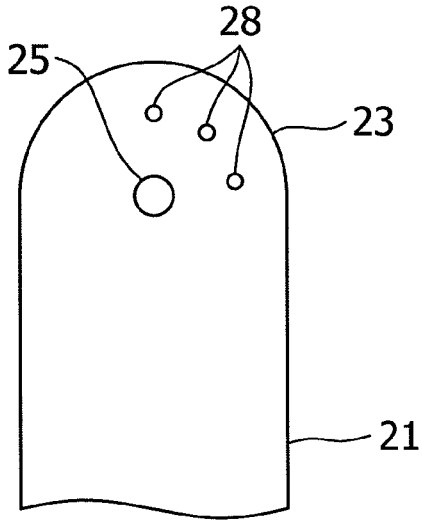
FIG. 4B is an enlarged view of an essential portion at the time and shows the back member side when a putter head in accordance with another embodiment is disassembled.

The positioning means is not limited to the configuration shown in FIG. 3, and by any other configuration as well, the position of the movable part 21 of the back member 20 can be turnably fixed to the body member 10. For example, as the positioning means, the configuration can be made so that a pin 38 is provided on the back surface 12*a* of the crown part 12 of the body member 10 as shown in FIG. 4A, and a plurality of holes 28 for accommodating the pin 38 are provided in the fixing part 23 of the back member 20 as shown in FIG. 4B. The plurality of holes 28 are provided so as to be positioned on the circumference concentric with the through hole 25 in the fixing part 23.

According to the above-described configuration, when the fixing part 23 of the back member 20 is to be fixed to the back surface 12*a* of the crown part 12, one hole that allows the movable parts 21 of the back member 20 to form a predetermined angle is selected from the plurality of holes 28 in the fixing part 23, and the pin 38 on the back surface 12*a* of the crown part 12 is inserted in the selected hole. Then, the external thread part of the screw 30 is inserted into the through hole 25 in the fixing part 23 and the threaded hole 16 in the back surface 12*a* of the crown part 12. By tightening the screw 30, the movable part 21 of the back member 20 can be fixed to the back surface 12*a* of the crown part 12 at the predetermined angle. In order for the movable part 21 of the back member 20 to be turned, the screw 30 is loosened, the pin 38 being drawn once from the hole 28 in the fixing part 23, then the pin 38 is inserted into another hole 28, and the screw 30 is tightened again. Thereby, the movable part 21 of the back member 20 can be fixed again at a position having a different angle.

In the above-described embodiment, since the back member has the two movable parts 21*a* and 21*b*, two screws 30 are used. However, if the number of movable parts 21 increases, the number of screws 30 as the number of movable parts 21 is used.

What is claimed is:

1. A putter head comprising:
- a body member having a face surface for hitting a ball and a back part, and
- a first movable part turnably attached to the body member, the first movable part being turnably attached to the body member with one screw only,
- wherein the first movable part is turnable about an axis extending vertically in a direction normal to a sole surface of the putter head,
- wherein the first movable part extends posterior to the back part of the body member,
- wherein the body member has a specific gravity less than that of the first movable part,
- wherein the body member has a hardness lower than that of the first movable part.

2. The putter head according to claim 1, wherein the putter head further comprises a means for fixing an angle of the first movable part turnable with respect to the body member.

3. The putter head according to claim 2, wherein the means for fixing the angle can fix the first movable part at a plurality of angles with respect to the body member.

4. The putter head according to claim 1, wherein the first movable part is attached to the main body such that rotating the first movable part with respect to the body member changes a moment of inertia of the putter head about a vertical axis.

5. A putter head comprising:
- a body member having a face surface for hitting a ball and a back part, and
- a first movable part turnably attached to the body member, the first movable part being turnably attached to the body member with one screw only,
- wherein the first movable part is turnable about an axis extending vertically in a direction normal to a sole surface of the putter head,
- wherein the first movable part extends posterior to the back part of the body member,
- further comprising a second movable part, and the first movable part and the second movable part being arranged on the toe side and the heel side of the body member, each of the first movable part and the second movable part being turnably installed with the one screw only.

6. The putter head according to claim 5, wherein the first and second movable parts are turned so that the first and second movable parts can come into contact with each other in tip end parts thereof and can separate.

7. The putter head according to claim 5, wherein the first movable part on the toe side comprises a tip end part thereof curving to the toe side, and wherein the second movable part on the heel side comprises a tip end part thereof curving to the heel side.

8. The putter head according to claim 5, wherein the first movable part is attached to the main body such that rotating the first movable part with respect to the body member changes a moment of inertia of the putter head about a vertical axis.

9. A putter head comprising:

a body member having a face surface for hitting a ball and a back part, and two movable parts, the two movable parts are arranged on the toe side and the heel side of the body member, each of the movable parts being turnably attached to the body member, wherein the movable parts are each independently turnable about an axis extending vertically in a direction normal to a sole surface of the putter head, wherein the movable parts each extend posterior to the back part of the body member.

10. The putter head according to claim 9, wherein the body member has a specific gravity less than that of the two movable parts.

11. The putter head according to claim 9, wherein the body member has a hardness lower than that of the two movable parts.

12. The putter head according to claim 9, wherein the putter head further comprises a means for fixing an angle of the two movable parts with respect to the body member.

13. The putter head according to claim 12, wherein the means for fixing the angle can fix the two movable parts at a plurality of predetermined angles with respect to the body member.

14. The putter head according to claim 9, wherein the two movable parts are turned so that the movable parts can come into contact with each other in tip end parts thereof and can separate.

15. The putter head according to claim 9, wherein the movable part on the toe side comprises a tip end part thereof curving to the toe side, and wherein the movable part on the heel side comprises a tip end part thereof curving to the heel side.

16. The putter head according to claim 9, wherein the first movable part is attached to the main body such that rotating the first movable part with respect to the body member changes a moment of inertia of the putter head about a vertical axis.

* * * * *